US011476607B2

(12) United States Patent
Wellmann et al.

(10) Patent No.: US 11,476,607 B2
(45) Date of Patent: Oct. 18, 2022

(54) ELECTRICAL CONNECTOR WITH COMPONENTS OF BETTER MATERIAL AND LITTLE LEAD, PREFERABLY ON THE BASIS OF COPPER

(71) Applicant: HARTING Electric Stiftung & Co. KG, Espelkamp (DE)

(72) Inventors: Christa Wellmann, Stemwede (DE); Marc Schleth, Lemförde (DE); Andreas Naß, Warmsen (DE); Martin Schmidt, Lübbecke (DE); Alexander Ellermann, Hunteburg (DE)

(73) Assignee: HARTING Electric Stiftung & Co. KG, Espelkamp (DE)

( * ) Notice: Subject to any disclaimer, the term of this patent is extended or adjusted under 35 U.S.C. 154(b) by 10 days.

(21) Appl. No.: 17/271,908

(22) PCT Filed: Aug. 16, 2019

(86) PCT No.: PCT/DE2019/100738
§ 371 (c)(1),
(2) Date: Feb. 26, 2021

(87) PCT Pub. No.: WO2020/043231
PCT Pub. Date: Mar. 5, 2020

(65) Prior Publication Data

US 2021/0320446 A1 Oct. 14, 2021

(30) Foreign Application Priority Data

Aug. 30, 2018 (DE) ..... 20 2018 104 958.5

(51) Int. Cl.
*H01R 13/03* (2006.01)
*C22C 9/02* (2006.01)
(Continued)

(52) U.S. Cl.
CPC ..... *H01R 13/03* (2013.01); *C22C 9/02* (2013.01); *C22C 9/04* (2013.01); *C22C 9/06* (2013.01);
(Continued)

(58) Field of Classification Search
CPC ..... H01R 4/18; H01R 13/03; H01R 13/05; H01R 43/048; H01R 43/16; C22C 9/02; C22C 9/04; C22C 9/06
(Continued)

(56) References Cited

U.S. PATENT DOCUMENTS 2,286,240 A * 6/1942 Stack ..... C25C 1/12 205/594
6,722,236 B1 4/2004 Baldini et al.
(Continued)

FOREIGN PATENT DOCUMENTS

CN 201717414 U 1/2011
CN 105406249 A 3/2016
(Continued)

*Primary Examiner* — Peter G Leigh
(74) *Attorney, Agent, or Firm* — Smartpat PLC

(57) ABSTRACT

An electrical connector consists of a connector housing (10) and at least one electrical contact element (1). The connector housing (10) and/or the electrical contact element (1) have a lead content of <0.1 weight percent. A method for manufacturing a contact element from a blank which has a lead content of <0.1 weight percent, uses the following method steps: Loading the blank into a manufacturing machine; producing a pin region or a socket region for electrically contacting another, opposite contact element; producing a fixing region for fixing the contact element in an insulating body; producing a crimp region for electrically connecting a conductor to the contact element or finishing the crimp region if the blank has already been previously prepared on
(Continued)

a different machine; and removing the finished contact element from the manufacturing machine.

8 Claims, 3 Drawing Sheets

(51) Int. Cl.

| | |
|---|---|
| ***C22C 9/04*** | (2006.01) |
| ***C22C 9/06*** | (2006.01) |
| ***H01R 4/18*** | (2006.01) |
| ***H01R 13/05*** | (2006.01) |
| ***H01R 43/048*** | (2006.01) |
| ***H01R 43/16*** | (2006.01) |

(52) U.S. Cl.
CPC ..... *H01R 4/18* (2013.01); *H01R 13/05* (2013.01); *H01R 43/048* (2013.01); *H01R 43/16* (2013.01)

(58) Field of Classification Search
USPC ..... 439/886
See application file for complete search history.

(56) References Cited

U.S. PATENT DOCUMENTS

| | | | | |
|---|---|---|---|---|
| 7,163,753 | B2 * | 1/2007 | Ota | H01R 13/53 428/673 |
| 9,209,567 | B2 * | 12/2015 | Schaefer | C22C 9/04 |
| 10,364,482 | B2 * | 7/2019 | Kuhn | C21D 8/0221 |
| 2003/0096513 | A1 | 5/2003 | Belopolsky et al. | |
| 2010/0258651 | A1 * | 10/2010 | Tekoral | C22C 9/06 239/289 |
| 2012/0207642 | A1 | 8/2012 | Zeiger et al. | |
| 2013/0115827 | A1 | 5/2013 | Ambrosy et al. | |
| 2015/0180173 | A1 * | 6/2015 | Schaefer | C22C 9/04 439/347 |
| 2016/0289797 | A1 | 10/2016 | Kuhn et al. | |
| 2017/0012399 | A1 | 1/2017 | Garske et al. | |
| 2017/0204501 | A1 | 7/2017 | Allmendinger et al. | |
| 2017/0229793 | A1 * | 8/2017 | Schmidt | H01R 4/206 |

FOREIGN PATENT DOCUMENTS

| | | | | | |
|---|---|---|---|---|---|
| CN | 106785554 | A | | 5/2017 | |
| CN | 110050390 | A | * | 7/2019 | B21C 23/186 |
| DE | 60212299 | | | 7/2006 | |
| DE | 102009038657 | A1 | | 2/2011 | |
| DE | 102010027082 | A1 | | 1/2012 | |
| DE | 102011053823 | A1 | | 3/2013 | |
| DE | 102011053823 | A1 | * | 3/2013 | C22C 9/04 |
| DE | 202012101303 | U1 | | 7/2013 | |
| DE | 102013014501 | A1 | | 3/2015 | |
| DE | 102013016814 | A1 | | 4/2015 | |
| DE | 102014104406 | A1 | | 10/2015 | |
| DE | 102014014239 | A1 | | 3/2016 | |
| DE | 102014112701 | A1 | | 3/2016 | |
| DE | 102015004221 | A1 | | 10/2016 | |
| DE | 102015212937 | A1 | | 1/2017 | |
| DE | 102016123935 | A1 | * | 6/2018 | H01R 43/16 |
| DE | 102016123936 | A1 | * | 6/2018 | B21C 23/186 |
| DE | 102017112193 | | | 10/2018 | |
| DE | 202018104958 | U1 | * | 10/2018 | C22C 9/00 |
| DE | 102018100440 | A1 | * | 7/2019 | |
| DE | 102016123936 | | | 4/2020 | |
| JP | 2014086215 | A | | 5/2014 | |
| WO | 9943464 | A2 | | 9/1999 | |

* cited by examiner

ELECTRICAL CONNECTOR WITH COMPONENTS OF BETTER MATERIAL AND LITTLE LEAD, PREFERABLY ON THE BASIS OF COPPER

TECHNICAL FIELD

The disclosure relates to a connector with a connector housing and at least one electrical contact element to establish an electrical and mechanical connection between two electrical lines or an electrical line and a device, in particular in an industrial environment.

BACKGROUND

Connectors and mating connectors are used to establish an electrical and mechanical connection between two electrical lines or an electrical line and a device, in particular in an industrial environment. Electrical contact elements are predominantly used in these connectors. The contact elements are needed to establish an electrical connection between an electrical conductor, in particular a stranded conductor, and a connection end of a pin contact or socket contact.

Crimping connection technology is frequently chosen to connect stranded conductors to an electrical contact element. The contact elements therefore have, at their conductor connection end, an axial bore in which the stripped end of the stranded conductor is inserted and is tightly squeezed by crimping. Screw connections, a cage clamp connection, press-in technology and different solder variants can also be provided as the connection technology.

DE 20 2012 101 303 U1 discloses a connector having a cylindrical connector housing. The cylindrical connector housing is produced with the aid of machining technology.

DE 10 2014 104 406 A1 discloses a contact element which is produced from solid material using a turning technique.

So-called rotary indexing machines, as described for example in WO 99/43464 A2, are used as manufacturing machines, in particular for contact elements. Such manufacturing machines have a plurality of workstations through which a workpiece or a blank pass in succession.

To improve the processing of the material to produce a clamping body, in particular within the context of a machining process, it is usual to add lead to the material of the clamping body. The connector housing of DE 20 2012 101 303 U1 and the contact element of DE 10 2014 104 406 A1 could hitherto only be produced from lead-containing materials. These lead additions are, however, disadvantageous in terms of satisfying the EU guidelines for lead-free products (regulations prohibiting the use of certain substances in the electrical industry or end-of-life vehicle regulations).

For better machinability, current solutions have a lead content of up to 4 weight percent (wt %). The mechanical and electrical properties of these contact materials are well established. Alternative solutions must therefore be based on these properties.

Lead is one of the most toxic heavy metals. If lead makes its way into the environment, it can cause substantial damage there. It therefore makes sense to omit lead to the greatest extent possible for ecological reasons.

SUMMARY

An object of the disclosure is to provide a connector which conforms to EU guidelines and is environmentally acceptable, whilst exhibiting good processability during its production.

The object is achieved by the subject matter as claimed.

The disclosed connector consists at least of a connector housing and at least one electrical contact element, wherein the connector generally has a plurality of electrical contact elements, which can be configured for transmitting high currents but also for rapid data transfer. In particular, the geometry of the contact elements is adapted to their respective task. The connector housing and/or the electrical contact element has or have a lead content of less than 0.1 weight percent (<0.1 wt %). Such a connector is deemed to be particularly environmentally friendly.

Tests have shown that the contact elements or the blanks from which they are manufactured must have a tensile strength Rm of ≥300 MPa and an elongation at break A11.3 of ≥5% according to EN ISO 6892-1 in order to satisfy industrial requirements.

The connector housing and/or the electrical contact element therefore consist of copper or a copper alloy whereof the lead content is <0.1 weight percent, wherein the connector housing and/or the electrical contact element has or have a tensile strength Rm of ≥300 MPa and an elongation at break A11.3≥ of 5%.

The tensile strength is one of a plurality of strength values of a material, the maximum mechanical tensile strength which the material withstands. In most cases, it is calculated from the results of the tensile test as the maximally reached tensile force Fmax in relation to the original cross-section A0 of the standardized tensile specimen.

In materials science, the elongation at break A is a value which indicates the residual elongation of the tensile specimen after breakage in relation to the initial measured length. It characterizes the deformability (or ductility) of a material and can be defined differently and also denoted by different symbols according to the characteristic mechanical behavior of the material types.

The elongation at break is the residual change in length $\Delta L$ in relation to the initial measured length L0 of a specimen in a tensile test after breakage has taken place $A=\Delta L/L0$. The initial measured length L0 is specified prior to the tensile test by measuring marks on the tensile specimen.

The connector housing or the electrical contact element, or the connector housing and the electrical contact element, preferably consists or consist of a copper zinc alloy.

The connector housing and/or the electrical contact element preferably consists of

- a copper zinc alloy (CuZn) with a zinc content of 35 weight percent to 42 weight percent or
- a copper tin alloy (CuSn) with a tin content of 4 weight percent to 8 weight percent or
- a copper nickel alloy (CuNi) with a nickel content of 0.5 weight percent to 30 weight percent or
- a copper nickel zinc alloy (CuNiZn) with a nickel content of 10 weight percent to 20 weight percent and with a zinc content of 20 weight percent to 30 weight percent or
- copper or a low-alloyed copper with additives of up to 3 weight percent.

The respective boundaries are each included in the value ranges.

In a particularly advantageous variant, the connector housing or the electrical contact element consists of CuZn32Mn2Si1Al or CuZn34Mn2SiAlNi or CuZn36 or CuZn37 or CuZn38 or CuZn39 or CuZn40 or CuZn42 or CuNi9Zn41FeMn or Cu-ETP or a mixture of the above-mentioned substances. Alternatively, the connector housing and the electrical contact element consist of CuZn32Mn2Si1Al or CuZn34Mn2SiAlNi or CuZn36 or CuZn37 or CuZn38 or CuZn39 or CuZn40 or CuZn42 or CuNi9Zn41FeMn or Cu-ETP or a mixture of the above-mentioned substances. Cu-ETP is an oxygen-containing (tough-pitch) copper produced by electrolytic refining, which has very good conductivity for heat and electricity (in the soft state at least 57 $m/\Omega \cdot mm^2$).

The substances preferably contain a lead-free admixture. The machining of the above-mentioned materials is thereby improved. The lead-free admixture preferably represents a content of 0.5 up to and including 1.5 weight percent. It is particularly advantageous if the lead-free admixture represents a content of less than or equal to 1 weight percent. It is particularly advantageous if the lead-free admixture contains Fe and/or Sn and/or Si and/or Ni.

All contact elements and metallic connector housings currently found in the product portfolio of the HARTING Technology Group, and the geometries thereof, can be realized using the above-mentioned materials. In this case, different geometries can be realized by different substances, for example. The contact elements and/or connector housing are realized, in particular, with the aid of turning technology (turning technique).

Turning, also referred to as turning technique or turning process within the context of the present document, is one of the most important manufacturing techniques in machining technology, together with boring, milling and grinding. As in all of these techniques, material is removed from a workpiece in order to produce the desired form. In turning, the workpiece—the turned part—rotates about its own axis, whilst the tool—the turning tool—moves along the contour to be produced on the workpiece. The corresponding machine tool is a lathe.

The electrical contact is generally prepared from solid material. To this end, the turning technology is used on cam- or CNC-controlled machines. However, machining procedures are also needed for the slot in the connection region of the contact element.

The contact region of the contact element can be designed both as a pin contact or as a socket contact. The connection region is designed, for example, as a crimp connection, in particular to enable electrical contacting of stranded conductors. The crimp connection is realized, in particular, by a boring technique on the contact element.

In the crimping procedure, the strands of an electrical conductor cable to be connected are inserted into the connection region designed as a hollow cylinder. The hollow cylinder is slotted in the axial direction and is thus open at the side. With the aid of a suitable crimping tool, a force is exerted on the lateral surface of the slotted hollow cylinder so that the opposing slot edges are bent and rolled inwards. The compressed strands of the conductor cable are now located in the residually deformed connection region of the contact element.

The contact element can be manufactured from a blank, for example, which passes through at least 8 workstations on the manufacturing machine in one production cycle. In these at least 8 workstations, the following manufacturing steps are carried out on the blank, which together produce a finished contact element:

loading the blank into the manufacturing machine;

producing a pin region or a socket region for establishing electrical contact with another, opposing contact element;

producing a fastening region for fastening the contact element in an insulating body;

producing a crimp zone for electrical connection of a conductor to the contact element or completing the crimp zone when preliminary work on the blank has already taken place on another machine;

unloading the finished contact element from the manufacturing machine.

The blank from which the contact element is manufactured has a connection region and a mating region. The connection region later serves for connecting an electrical conductor to the contact element. The mating region serves for establishing electrical contact with a corresponding mating contact element.

In the manufacturing process for a so-called pin contact a) The blank is turned in the mating region. This refers to a machining process in which material is removed. In the turning process, the diameter in the mating region is reduced to a desired size.

b) A bore is incorporated axially in the connection region of the blank. This bore represents the opening of the contact element for the crimp connection.

c) The blank is optionally provided with an axial slot in the connection region and a further slot perpendicularly thereto.

In the manufacturing process for a so-called socket contact a) The blank is drilled and then slotted in the mating region. With this, the so-called contact lamellae are produced, which later encompass the mating region of the pin contact.

b) A bore is incorporated axially in the connection region of the blank. This bore represents the opening of the contact element for the crimp connection.

c) The blank is optionally provided with an axial slot in the connection region and a further slot perpendicularly thereto.

The contact element is advantageously provided with an outer coating, for example to optimize the electrical conductivity or the current-carrying capacity of the contact element. This can be, for example, a silver tungsten alloy, which can be deposited in particular using an electroless galvanic coating technique. The layer thickness of the deposited silver tungsten alloy can be 0.05 up to and including 0.5 micrometers, preferably 0.05 up to and including 0.3 micrometers, wherein, with a layer thickness of 0.25 μm, the silver tungsten alloy deposited using the electroless technique has a comparable wear-through resistance to a comparable pure silver layer with a layer thickness of 3.0 micrometers.

Alternatively, the contact element can be provided with a silver or silver alloy coating. The thickness of the deposited silver or silver alloy coating, including the carbon nanoparticles, is 0.05 up to and including 7.0 micrometers, but preferably 0.1 up to and including 3.0 micrometers.

BRIEF DESCRIPTION OF THE DRAWINGS

An exemplary embodiment of the invention is illustrated in the drawings and will be explained in more detail below.

DETAILED DESCRIPTION

The figures contain partially simplified, schematic illustrations. Identical reference sign are sometimes used for elements which are similar, but possibly not identical. Different views of similar elements may be drawn to different scales.

The HARTING Technology group has made product catalogs and datasheets of all current products and their components available on the internet in the so-called download center (http://www.harting.com/DE/de/downloadcenter). In the following figures, contact elements are shown which can be produced, for example, with the above-mentioned materials, in particular with the aid of the machining technology. However, the geometrical diversity of the contact elements which can be produced with the said materials is not restricted.

Figure 1:
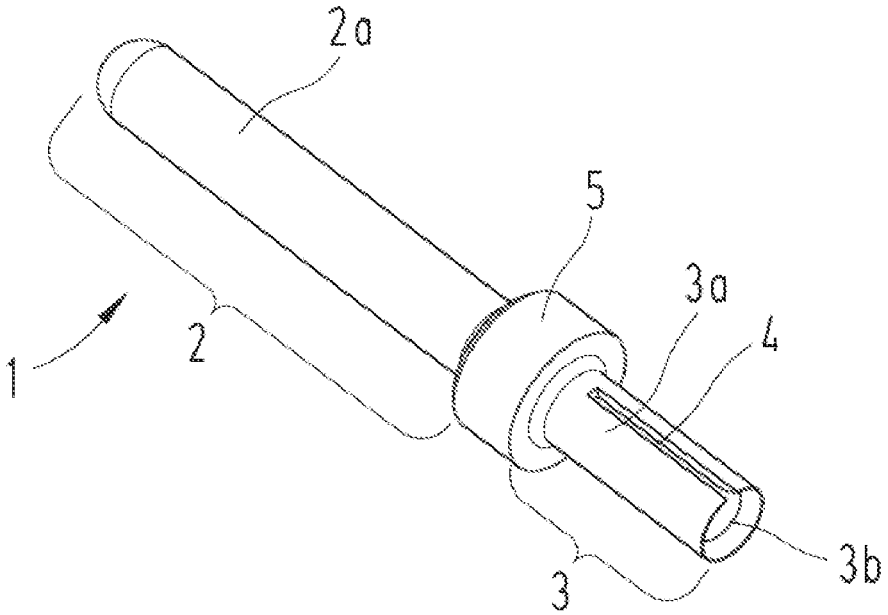
FIG. 1 shows a perspective illustration of a pin contact.

FIG. 1 shows a perspective illustration of a pin contact. The contact element 1 can be divided into a contact region 2 and a connection region 3. The contact region 2 is designed as a pin contact 2*a*. The connection region 3 is formed by a hollow cylinder 3*a*, which contains an axial slot 4. A ring element 5 is located between the contact region and the connection region. An insulating body (not shown here), which is provided for receiving contact pins, contains a recess into which the ring element 5 of the contact pin can be placed. The contact pin is thus held in the insulating body.

Figure 2:
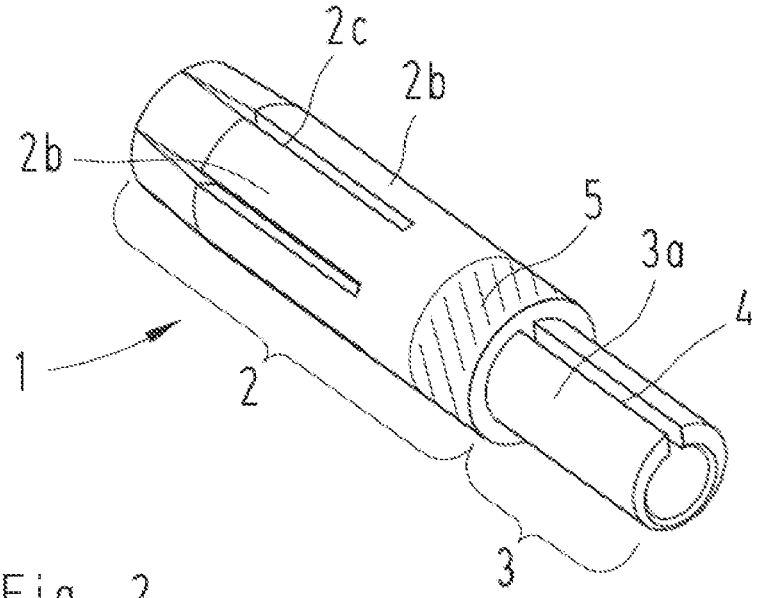
FIG. 2 shows a perspective illustration of a socket contact.

FIG. 2 shows a perspective illustration of a socket contact. The contact region 2 is formed from a hollow cylinder in which wedge-shaped slots 2*c* are incorporated so that individual spring arms 2*b* are formed. The end regions of the spring arms are bent inwards towards the insertion orifice, so that a circular insertion orifice is formed. The ring element 5 here has substantially the same diameter as the socket-shaped contact region 2.

Figure 3:
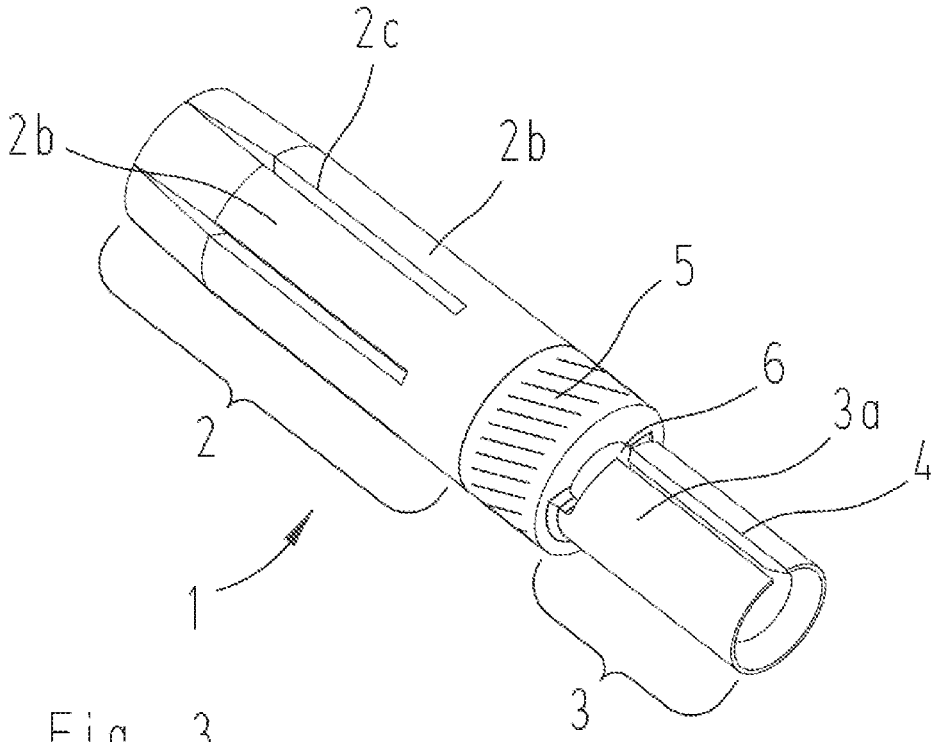
FIG. 3 shows a perspective illustration of a variant of the socket contact.

FIG. 3 shows a further variant of the socket contact. Similar parts also have the same reference sings. In addition to the axial slot 4, the connection region 3 of this socket contact has a second slot 6, which is aligned substantially transversely to the axial slot 4.

Figure 4:
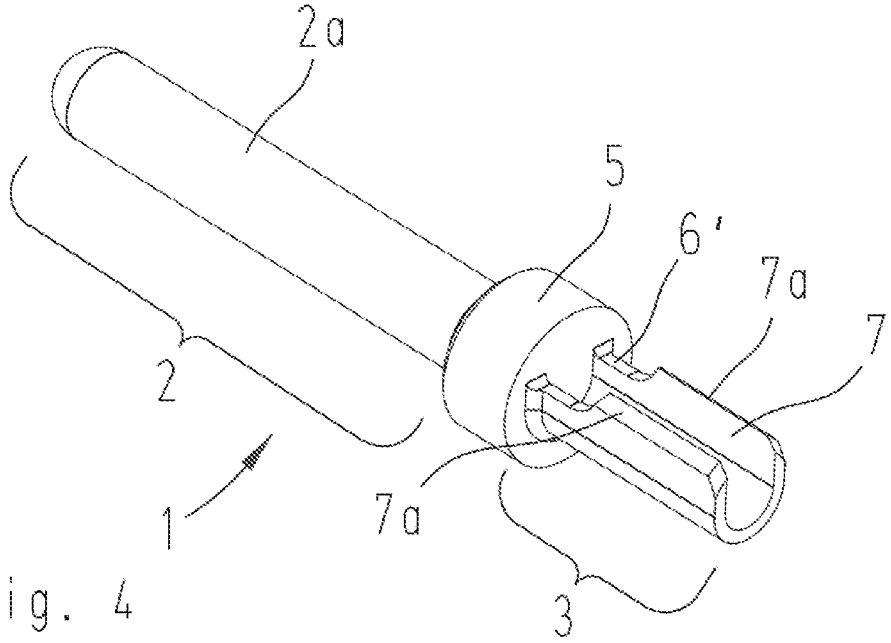
FIG. 4 shows a perspective illustration of a variant of the pin contact.

FIG. 4 shows a further variant of a pin contact. The contact pin has a U-profile 7 in the connection region 3. In the direction of the ring element 5, and parallel thereto, a wedge-shaped slot 6' is incorporated in the U-profile 7. The flanks 7*a* of the U-profile are beveled. In other embodiments, the flanks 7*a* can also be parallel or inclined inwards or outwards.

Figure 5:
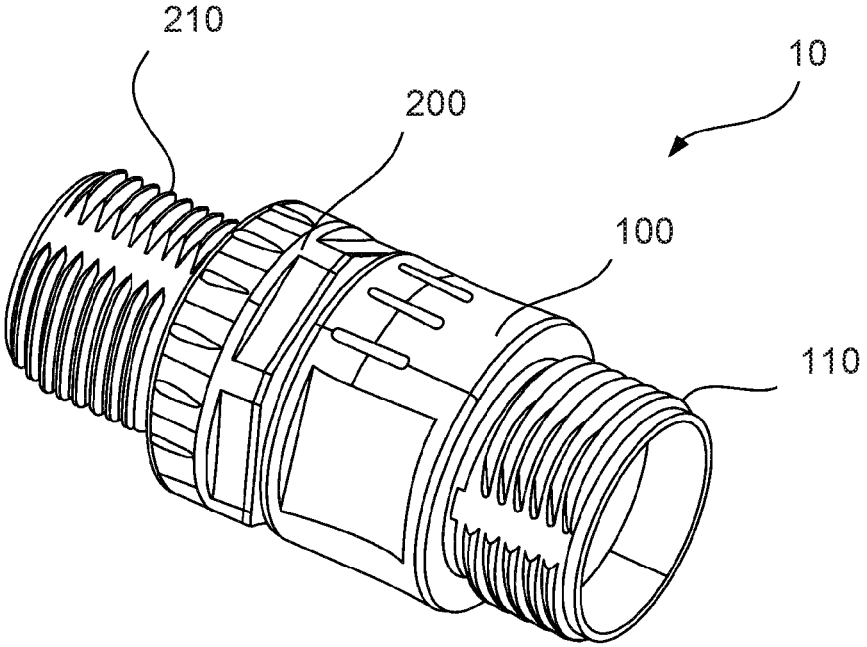
FIG. 5 shows a perspective illustration of a connector housing of a circular connector.

FIG. 5 shows a perspective view of a connector housing 10. However, the geometrical diversity of the connector housing which can be produced with the said materials is not restricted. FIG. 5 shows a perspective view of a connector housing 10, which can be produced from the above-mentioned lead-free materials. It is also the case here that there are no geometrical limits for the said materials when manufacturing a connector housing 10.

The connector housing 10 consists of a base body 100, which forms a mating side and a cable outlet side. On the mating side, the contact elements (not shown) form the mating face of the connector. The contact elements can be pin contacts or socket contacts, which are produced according to the method presented above, for example.

On the cable outlet side, the base body 100 has an external thread 110 via which a cable gland with integrated strain relief can be screwed on.

The locking element 200 is pushed onto a cylindrical elongation of the base body 100 on the mating side. At the end, an external thread 210 is provided, via which the connector housing 10 can be connected to a mating connector and/or a device socket.

Even where combinations of various aspects or features of the invention are shown in the figures in each case, it is clear to a person skilled in the art—unless indicated otherwise—that the combinations shown and discussed are not the only possible combinations. In particular, mutually corresponding units or feature complexes from different exemplary embodiments can be interchanged with one another.

LIST OF REFERENCE SIGNS

1 Contact element
2 Contact region
2*a* Contact pin
2*b* Contact socket
2*c* Wedge-shaped slot
3 Connection region
3*a* Hollow cylinder
3*b* Base area
4 Axial slot
5 Ring element
5*a* Notch
6 Second slot
6' Wedge-shaped slot
7 U-profile
7*a* Edge
10 Connector housing
100 Base body
110 External thread
200 Locking element
210 External thread

The invention claimed is:

1. A connector, comprising:
a connector housing (10) and,
at least one electrical contact element (1),
wherein the connector housing (10) and/or the electrical contact element (1) has/have a lead content of <0.1 weight percent,
wherein the connector housing (10) and/or the electrical contact element (1) consists of:
CuZn32Mn2Si1Al or CuZn34Mn2SiAlNi or CuZn36 or CuZn37 or CuZn38 or CuZn39 or CuZn40 or CuZn42 or CuNi9Zn41FeMn or Cu-ETP or a mixture thereof and;
a lead-free admixture, and
wherein the lead-free admixture represents a content of less than or equal to 1 weight percent.

2. The connector as claimed in claim 1,
wherein the connector housing (10) and/or the electrical contact element (1) are formed from copper or a copper alloy whereof the lead content is <0.1 weight percent and,
wherein the connector housing (10) and/or the electrical contact element (1) has/have a tensile strength Rm of ≥300 MPa and an elongation at break A11.3 of ≥5%.

3. The connector as claimed in claim 1,
wherein the connector housing (10) and/or the electrical contact element (1) consist(s) of a copper zinc alloy.

4. The connector as claimed in claim 1,
wherein the connector housing (10) and/or the electrical contact element (1) consist of:
a copper zinc alloy (CuZn) with a zinc content of 35 weight percent to 42 weight percent or, a copper tin alloy (CuSn) with a tin content of 4 weight percent to 8 weight percent or, a copper nickel alloy (CuNi) with a nickel content of 0.5 weight percent to 30 weight percent or, a copper nickel zinc alloy (CuNiZn) with a nickel content of 10 weight percent to 20 weight percent and with a zinc content of 20 weight percent to 30 weight percent or, copper or a low-alloyed copper with additives of up to 3 weight percent.

5. The connector as claimed in claim 1, wherein the lead-free admixture contains Fe and/or Sn and/or Si and/or Ni.

6. A connector, comprising:

a connector housing (10) and;

at least one electrical contact element (1), wherein the connector housing (10) and/or the electrical contact element (1) has/have a lead content of <0.1 weight percent, wherein the connector housing (10) and/or the electrical contact element (1) consists of:

CuZn32Mn2Si1Al or CuZn34Mn2SiAlNi or CuZn36 or CuZn37 or CuZn38 or CuZn39 or CuZn40 or CuZn42 or CuNi9Zn41FeMn or Cu-ETP or a mixture thereof and;

a lead-free admixture, and wherein the lead-free admixture represents a content of 0.5 up to and including 1.5 weight percent.

7. The connector as claimed in claim 6, wherein the lead-free admixture represents a content of less than or equal to 1 weight percent.

8. The connector as claimed in claim 6, wherein the lead-free admixture contains Fe and/or Sn and/or Si and/or Ni.

* * * * *